US006883961B1

(12) United States Patent
Ray

(10) Patent No.: US 6,883,961 B1
(45) Date of Patent: Apr. 26, 2005

(54) HINGED ELECTRONIC WATCH

(75) Inventor: Claude Ray, Montezillon (CH)

(73) Assignee: TIMENTEL Pty Limited, Newcastle (AU)

( * ) Notice: Subject to any disclaimer, the term of this patent is extended or adjusted under 35 U.S.C. 154(b) by 0 days.

(21) Appl. No.: 10/031,649

(22) PCT Filed: May 11, 2000

(86) PCT No.: PCT/CH00/00262

§ 371 (c)(1),
(2), (4) Date: Apr. 12, 2002

(87) PCT Pub. No.: WO00/70413

PCT Pub. Date: Nov. 23, 2000

(30) Foreign Application Priority Data

May 17, 1999 (FR) ..... 99 06317

(51) Int. Cl.[7] ..... G04B 37/00
(52) U.S. Cl. ..... 368/281; 368/88
(58) Field of Search ..... 368/88, 276, 280–282, 368/291, 292, 309–310

(56) References Cited

U.S. PATENT DOCUMENTS 4,412,751 A * 11/1983 Jeannet et al. ..... 368/276
5,615,179 A 3/1997 Yamamoto et al.

FOREIGN PATENT DOCUMENTS

CH 659 571 A 2/1987
DE 8530739 U 4/1986

* cited by examiner

*Primary Examiner*—Kamand Cuneo
*Assistant Examiner*—Jeanne-Marguerite Goodwin
(74) *Attorney, Agent, or Firm*—Young & Thompson

(57) ABSTRACT

An articulated watch includes two juxtaposed cases, each containing an electronic movement, and a connector for mechanically joining the two cases in an articulated manner and allowing the two movements to be connected using electrical conductors. The connector is formed of two bars that are arranged on either side of the cases. The bars include an internal channel for the passage of the electrical conductors and have ends that are mounted so as to rotate freely but are locked in translation in four holes arranged in the middle parts of the cases along two substantially parallel axes.

7 Claims, 3 Drawing Sheets

HINGED ELECTRONIC WATCH

BACKGROUND OF THE INVENTION

The present invention concerns an articulated electronic watch, that includes two juxtaposed cases which are joined to each other in an articulated manner.

A watch of this type is disclosed in Swiss Patent No. 647 916. The back covers of the two cases are articulated to each other by means of simple hinges. Sandwiched between the back cover and middle part of each case is a sealing gasket connected to the gasket of the adjoining case, at the location of the articulation, by a neck made of the same material, the assembly thus forming a sealing gasket in one piece. Electric conductors are arranged inside the necks to connect the electronic components of the two cases to each other.

Such a solution enables the realisation of a watch which can occupy a relatively large surface area on the wearer's wrist, while matching the shape thereof. However, it has the drawback of requiring articulations occupying practically the entire width of the case. This results in a certain heaviness of appearance. Moreover, the effect procured by the presence of two movements in two separate cases is not used to advantage.

SUMMARY

The object of the present invention is to enable the realisation of a watch which includes several distinctly separate cases, but which has a particularly light appearance, allows numerous variants, can easily be adapted to the wearer's arm and allows sealing to be assured by simple means.

More precisely, the invention concerns an articulated watch of the type including:

- two juxtaposed cases, each containing an electronic movement and including a back cover, a middle part and a crystal, and
- connecting means for mechanically joining the two cases in an articulated manner and allowing the two movements to be connected using electrical conductors.

This watch is characterised in that said connecting means are formed of two bars which are arranged on either side of the cases, which include an internal channel for the passage of the electrical conductors and whose ends are mounted so as to rotate freely but that are locked in translation in four holes arranged in the middle parts of the cases along two substantially parallel axes, there being two coaxial holes per case.

Advantageously, the ends of the bars are fitted with a sealing gasket disposed within a groove arranged in the portion thereof which passes through the hole of the middle part, while the ends of the channels which open into the cases are closed in a watertight manner. The channels can also be filled with an organic material in which the electrical conductors are embedded.

According to a preferred embodiment, the ends of each bar have an end portion projecting into the interior of the cases which includes a groove co-operating with a wedge in order to prevent any axial movement of the bar. Moreover, this end portion also includes means for limiting the rotational movement of the bar.

Each bar is advantageously formed of a hollow median portion and two end portions which are formed of a cylindrical tube fixed to the median portion. The median portion includes a base comprising two holes into which the tubes are fixed, walls substantially perpendicular to the base and a cap covering said walls.

BRIEF DESCRIPTION OF THE DRAWINGS

Other advantages and features of the invention will appear from the following description, which is made with reference to the annexed drawings, in which.

DESCRIPTION OF THE PREFERRED EMBODIMENTS

Figure 1:
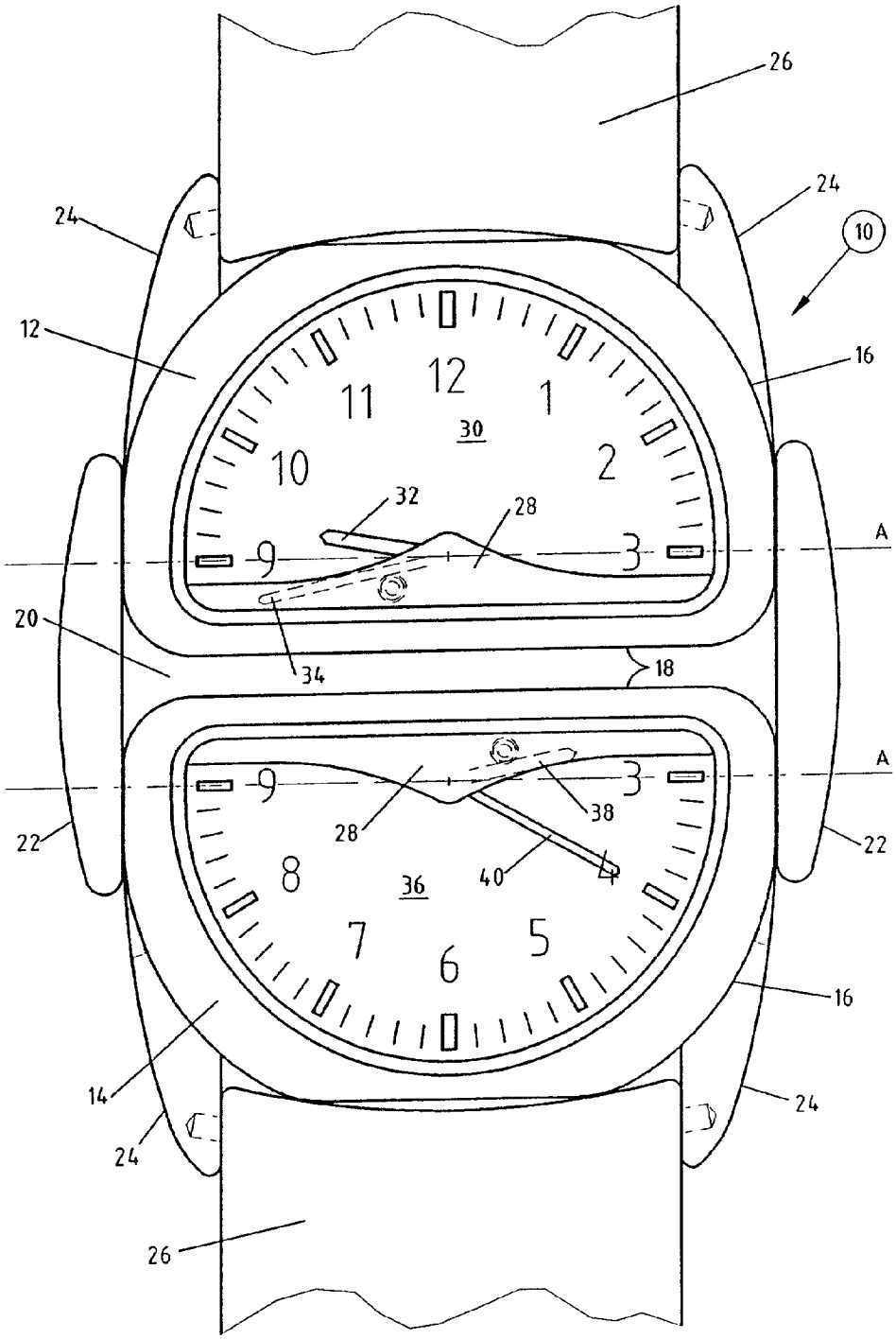
FIG. 1 shows an overall view of a watch according to the invention.

Electronic watch 10 shown in FIG. 1 includes two identical cases, an upper case 12, and lower case 14, substantially in the shape of a semi-circle, with a rounded portion 16 and a rectilinear portion 18. They each contain an analogue quartz movement (not shown).

Rectilinear portions 18 of the two cases are parallel to each other but not in contact, so that there exists between them a gap 20, which is sufficiently large, typically from 1 to 2 mm, to show clearly that there are two completely separate and independent cases.

Cases 12 and 14 are joined by two lateral bars 22 which are perpendicular to their rectilinear portions 18 and are fixed symmetrically in an articulated manner around two parallel axes A by each of their ends in four holes arranged in rounded portions 16, there being two coaxial holes per case. In such a watch, it is very desirable for the link between the two cases to be articulated in such a way that it matches the shape of the wrist as well as possible. Bars 22 are also used to pass lead wires between the two cases assuring the electrical connection between their respective movements. They will be described in more detail with reference to FIGS. 2 to 4.

Cases 12 and 14 each include, in a conventional manner, a pair of horns 24 used respectively for attaching the two strands of a wristlet 26.

Each case 12 and 14 has a crystal, not visible in the drawing, coated on the inside, in the portion thereof contiguous to rectilinear portion 18, with a mask 28 the use of which will appear hereinafter.

Upper case 12 is fitted with a semi-dial 30 above which are situated an hour hand 32 and a minute hand 34. Likewise, lower case 14 is fitted with a semi-dial 36 above which are situated an hour hand 38 and a minute hand 40. Upper semi-dial 30 includes markings for the time display between 9 and 3 o'clock, while lower semi-dial 36 includes markings for the time display between 3 and 9 o'clock. Together, they thus constitute the normal dial of a watch.

Each of the analogue movements placed in the cases includes, for driving each hand, a motor and a gear train. One of them contains the electronic circuit driving the four motors in a co-ordinated manner, while the other contains the battery for the electric power supply of the whole.

Upper case 12 displays the hours comprised between 9 and 3 and the minutes comprised between 45 and 15, while lower case 14 displays the hours comprised between 3 and 9 and the minutes comprised between 15 and 45. Thus, the watch of FIG. 1 displays 9 o'clock by means of hand 32 of upper case 12, and 20 minutes by means of hand 40 of lower case 14. Minute hand 34 and hour hand 38 are then hidden by masks 28.

When a hand reaches the end of its travel, the electronic circuit rapidly causes it to move backwards, via a rotation slightly greater than 180°, into a standby position behind mask 28. The hand of the other case then takes over.

A detailed description of the means implemented to perform the above functions is provided in the French Patent Application entitled <<WATCH WITH SECTOR DISPLAY>> filed by the Applicant on the same date as the present Application.

Figure 2:
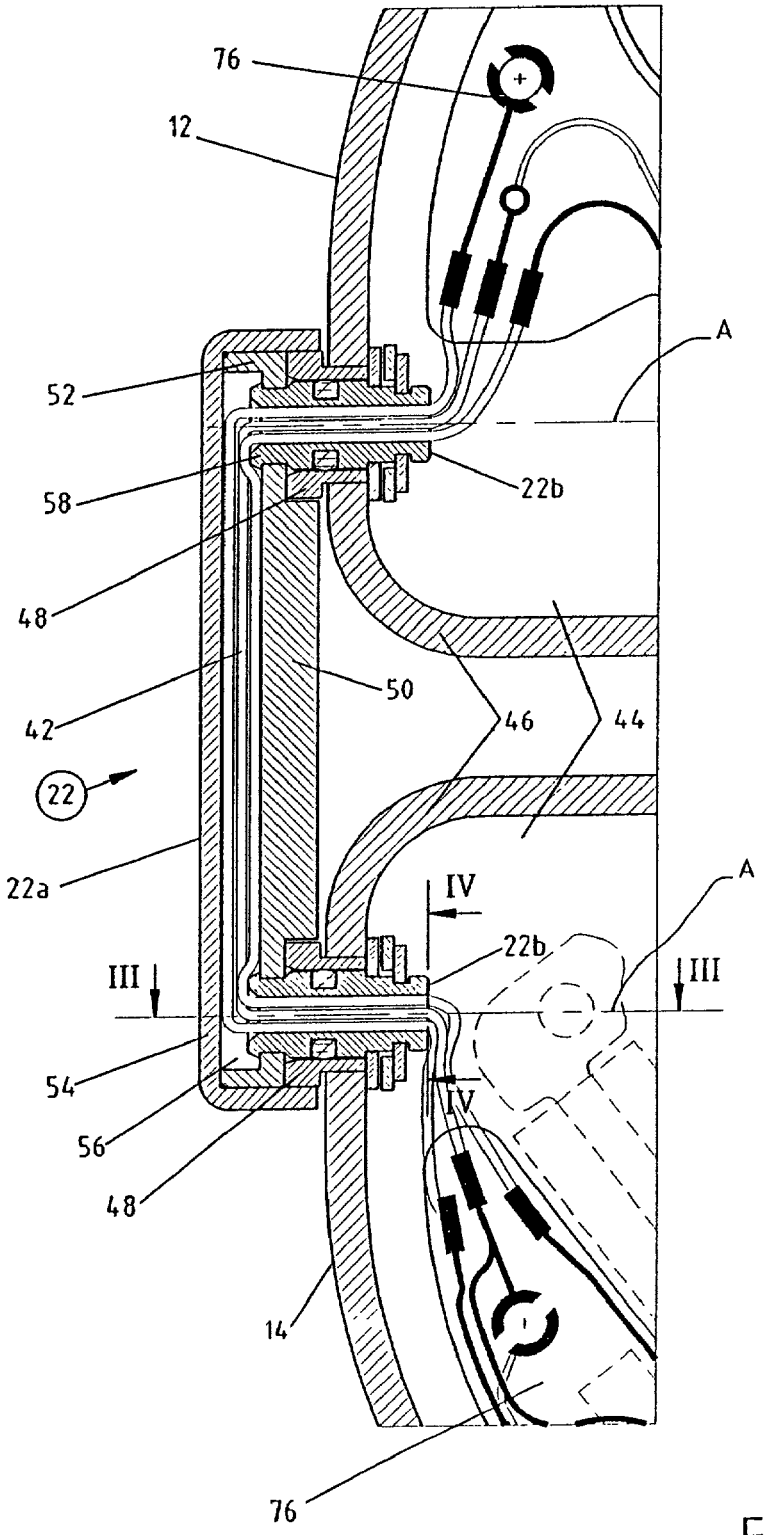
FIG. 2 shows, along a cross-section in the thickness of the watch of FIG. 1, a bar connecting the portions of the cases in which its ends are engaged.
Figure 3:
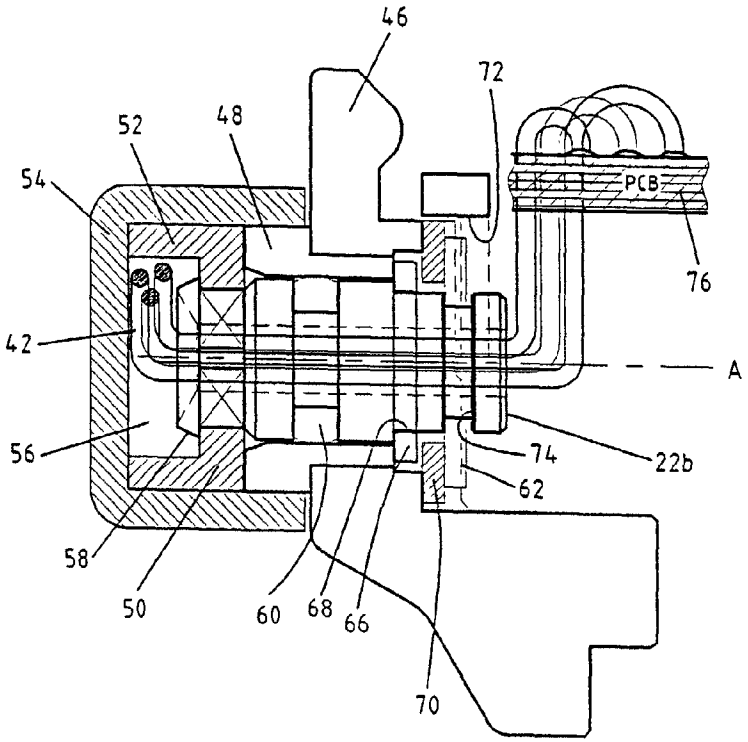
FIGS. 3 and 4 are partial enlarged views of FIG. 2 respectively along the lines III—III and IV—IV.
Figure 4:
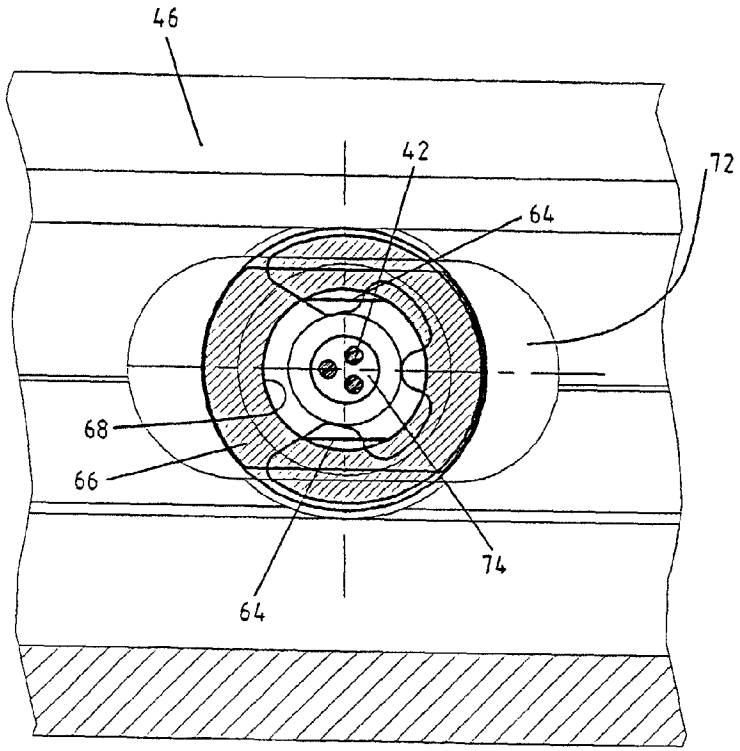

Reference will now be made to FIGS. 2 to 4 which show the manner in which bars 22 assure not only the articulated mechanical connection between the two cases while preserving the sealing thereof, but also their electrical connection by providing passages for a plurality of lead wires 42.

Cases 12 and 14 each include a back cover 44 and a middle part 46 which is perforated, along axis A, with a cylindrical channel accommodating a sleeve 48. It is to be noted that sleeve 48 is not indispensable but in the absence thereof the accuracy of the mechanism is liable to be insufficient to assure sealing of the passage.

Bar 22 is formed of a median portion 22*a* perpendicular to axes A and two end portions 22*b* which are respectively coaxial to said axes. Median portion 22 includes a base 50 the ends of which have a recess occupying space on sleeves 48, walls 52 perpendicular to base 50, and a cap 54 covering walls 52 onto which it is bonded or welded. A channel 56 is thus formed between base 50 and cap 54.

As FIG. 3 shows in more detail, each end portion 22*b* is formed of a cylindrical tube 58 driven in a water resistant manner by its end into a hole made in base 50. Tube 58 is itself engaged in sleeve 48 inside which it is fitted as so to be able to rotate freely. Tube 58 further includes in its median portion which passes through sleeve 48, a first groove accommodating a sealing gasket 60 and at its other end situated inside the case second groove for locking a wedge 62 which allows the bar to be fixed in an articulated manner.

As can be seen more particularly in FIG. 4, tube 58 includes, between the inner face of sleeve 48 and wedge 62, two diametrically opposite flat portions 64 which co-operate with an elongated plate 66 fitted with an oblong hole 68. This plate is held in place by a washer 70 inserted between the plate and wedge 62. In order to realise an articulation of limited amplitude, a groove 72 is made in the inner face of the middle part, in which plate 66 is engaged and whose width is substantially greater than that of said plate, which allows the bar to pivot over a certain amplitude.

As FIG. 2 shows, lead wires 42 pass from one case to the other making use of channel 56. They are distributed in the two bars 22, one being used, for example, for supply conductors and the other for the control conductors.

Since the shape of cap 54 can, for reasons of aesthetic effect, be quite complex, it is difficult to assure a perfectly watertight connection of the system. It is also advantageous to close the holes of tubes 58, for example by means of a drop of glue 74 arranged at the end of said holes within the case. In a variant, the bar can simply be filled with an organic material in which the electrical lead wires are embedded.

The structure of the bars which have just been described allows a high level of security to be assured as regards sealing, while providing great aesthetic variety. Indeed, one need only manufacture caps 54 which are different in shape or in the material selected, to considerably change the general appearance of the watch. Two colour timepieces can thus be made by using caps made of gold, the cost of which remains modest and which gives the watch a very elegant appearance.

As can be seen in FIGS. 2 and 4, the electrical connecting wires 42 can be simply welded onto printed circuits 76 included in the two movements. It would also be possible to fix sockets to the end of the wires, the latter then being screwed onto the printed circuits. In another variant, the electrical connection could also be made by means of a flexible printed circuit.

In the example described, the watch includes analogue display means in both cases. It goes without saying that other variants could be envisaged without thereby departing from the scope of the present invention. It would thus be possible to place an analogue display in one case and a digital display in the other, controlled by a single same quartz, or even to arrange a power supply provided with a generator in one of the cases and a conventional electronic movement in the other.

What is claimed is:

1. An articulated watch, comprising:

two juxtaposed cases that each contains an electronic movement, a back cover, a middle part and a crystal, each of said two cases having two coaxial holes in said middle part, an axis of said two coaxial holes in a first of said two cases being substantially parallel to an axis of said two coaxial holes in a second of said two cases; and two connecting bars on sides of said two cases that mechanically join said two cases in an articulated manner, each of said two connecting bars including an internal channel for an electrical conductor that is connected to respective ones of said electronic movement;

wherein ends of said two connecting bars are rotationally mounted in respective ones of said two coaxial holes, and wherein said ends have projecting parts inside said two cases that each has a groove cooperating with a wedge to prevent axial movement of said two connecting bars.

2. The watch of claim 1, further comprising a sealing gasket in said groove.

3. The watch of claim 1, wherein ends of said internal channel are sealed watertight.

4. The watch of claim 1, wherein said internal channel includes an organic material in which said electrical conductor is embedded.

5. The watch of claim 1, further comprising means for limiting rotation of said two connecting bars.

6. The watch of claim 1, wherein each of said two connecting bars comprises a hollow median portion, and wherein each of said ends comprises a cylindrical tube that is fixed to said hollow median portion.

7. The watch of claim 6, wherein said hollow median portion comprises a base with two holes that each receives one said cylindrical tube, walls substantially perpendicular to said base, and a cap fixed to and covering said walls.

* * * * *